US010325581B2

(12) United States Patent
Ogasawara

(10) Patent No.: US 10,325,581 B2
(45) Date of Patent: Jun. 18, 2019

(54) SINGING VOICE EDIT ASSISTANT METHOD AND SINGING VOICE EDIT ASSISTANT DEVICE

(71) Applicant: YAMAHA CORPORATION, Hamamatsu-shi (JP)

(72) Inventor: Motoki Ogasawara, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/145,729

(22) Filed: Sep. 28, 2018

(65) Prior Publication Data

US 2019/0103083 A1 Apr. 4, 2019

(30) Foreign Application Priority Data

Sep. 29, 2017 (JP) ..... 2017-191623

(51) Int. Cl.
*G10H 7/00* (2006.01)
*G10H 1/00* (2006.01)

(52) U.S. Cl.
CPC ..... *G10H 1/0008* (2013.01); *G10H 7/008* (2013.01); *G10H 2210/331* (2013.01); *G10H 2220/116* (2013.01); *G10H 2250/455* (2013.01)

(58) Field of Classification Search
CPC ..... G10H 1/0008; G10H 7/008; G10H 2220/116; G10H 2210/331; G10H 2250/455
(Continued)

(56) References Cited

U.S. PATENT DOCUMENTS

2012/0031257 A1* 2/2012 Saino ..... G10H 1/0058 84/622
2013/0112062 A1* 5/2013 Iriyama ..... G10H 1/0008 84/453
(Continued)

FOREIGN PATENT DOCUMENTS

EP 2530671 A2 12/2012
JP 2012022121 A 2/2012
(Continued)

OTHER PUBLICATIONS

Extended European Search Report issued in European Appln. No. 18197543.4 dated Feb. 26, 2019.

*Primary Examiner* — Jeffrey Donels
(74) *Attorney, Agent, or Firm* — Rossi, Kimms & McDowell LLP

(57) ABSTRACT

A singing voice edit assistance method, performed by to computer, includes: judging whether phoneme data based on which waveform data for listening contained in a data set for singing synthesis is synthesized, is available or not for a user to edit a singing voice, the data set for singing synthesis containing score data representing a time series of notes, a lyrics data representing words corresponding to the respective notes; and synthesizing the waveform data for listening while shifting pitches of phoneme data, representing waveforms of phonemes, indicated by the lyrics data to pitches indicated by the score data and connecting the pitch-shifted phoneme data and, if the indicated phoneme data is not available, the synthesizing synthesizes waveform data for listening based on the score data, the lyrics data, and substitute phoneme data available for the user instead of the indicated phoneme data.

8 Claims, 6 Drawing Sheets

(58) Field of Classification Search
USPC ..... 84/604
See application file for complete search history.

(56) References Cited

U.S. PATENT DOCUMENTS

| | | | | |
|---|---|---|---|---|
| 2014/0136207 | A1* | 5/2014 | Kayama | G10L 13/08 704/258 |
| 2014/0278433 | A1* | 9/2014 | Iriyama | G10L 13/02 704/261 |
| 2015/0040743 | A1* | 2/2015 | Tachibana | G10H 1/361 84/622 |
| 2015/0310850 | A1* | 10/2015 | Nakano | G10L 13/10 704/258 |
| 2016/0133246 | A1* | 5/2016 | Ogasawara | G10L 13/033 704/260 |
| 2017/0025115 | A1* | 1/2017 | Tachibana | G10L 13/0335 |
| 2018/0166064 | A1* | 6/2018 | Saino | G10L 13/00 |
| 2018/0268792 | A1* | 9/2018 | Serletic | G10L 25/48 |

FOREIGN PATENT DOCUMENTS

| | | | |
|---|---|---|---|
| JP | 2015011146 | A | 1/2015 |
| JP | 2015011147 | A | 1/2015 |

* cited by examiner

| | |
|---|---|
| HARD EFFECT SET | • STRONG COMPRESSOR<br>• V-SHAPED SOUND EQ |
| WARM EFFECT SET | • SOFT DELAY<br>• REVERBERATION |

FIG. 5A
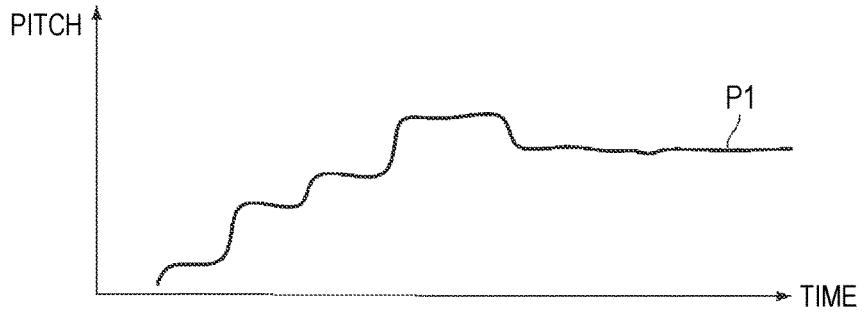
FIG. 5B
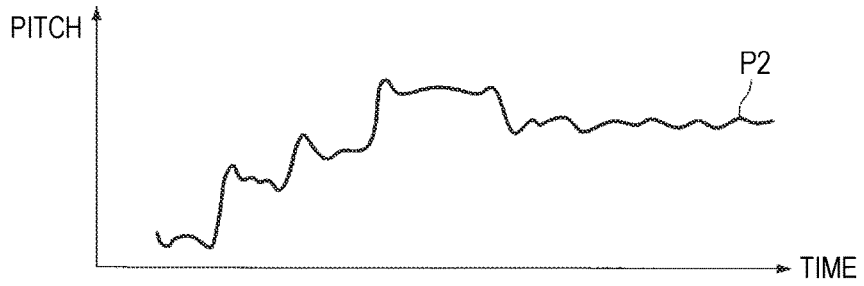
FIG. 5C
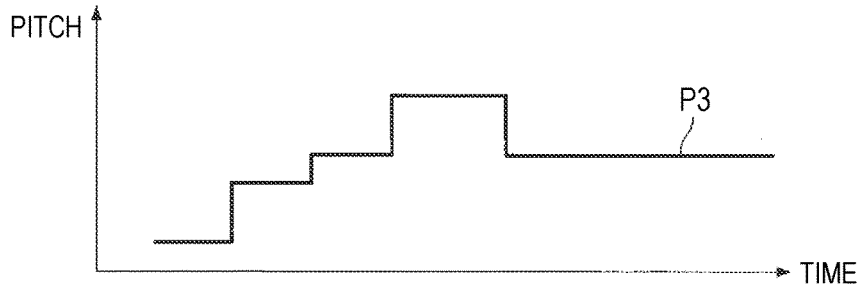
FIG. 6
| SINGING VOICE IDENTIFIER | MUSIC GENRE IDENTIFIER | SECOND EDIT DATA | FIRST EDIT DATA |
|---|---|---|---|
| SINGER-1 | HARD R & B | P2 | HARD EFFECT SET |
| SINGER-2 | WARM R & B | P2 | WARM EFFECT SET |
| SINGER-1 | HARD ROBOT | P3 | HARD EFFECT SET |
| SINGER-2 | WARM ROBOT | P3 | WARM EFFECT SET |

SINGING VOICE EDIT ASSISTANT METHOD AND SINGING VOICE EDIT ASSISTANT DEVICE

CROSS REFERENCE TO RELATED APPLICATIONS

This application is based on Japanese Patent Application (No. 2017-191623) filed on Sep. 29, 2017, the contents of which are incorporated herein by reference.

BACKGROUND OF THE INVENTION

1. Field of the Invention

The present invention relates to a technique for assisting a user to edit a singing voice.

2. Description of the Related Art

In recent years, various singing synthesis techniques for synthesizing a singing voice electrically have been proposed. For example, JP-A-2015-011146 and JP-A-2015-011147 disclose techniques for facilitating synthesis of a singing voice by generating, in advance, in units of an interval of a portion of a song (e.g., phrase), plural data sets for singing synthesis each consisting of score data representing a time series of notes corresponding to a temporal pitch variation, lyrics data representing words that are pronounced so as to be synchronized with the respective notes, and singing voice data representing a waveform of a singing voice synthesized on the basis of the score data and the lyrics data, and arranging the plural data sets for singing synthesis in time-series order.

The singing voice data contained in each data set for singing synthesis is waveform data for listening to be used for trial listening for checking an auditory sensation of a phrase corresponding to the data set for singing synthesis in advance. In general, synthesis of singing voice data necessitates not only score data and lyrics data but also a singing synthesis database that contains various phonemes. A wide variety of singing synthesis databases have come to be marketed in recent years and are available via a communication network such as the Internet. This very easily produces a situation that a singing synthesis database that is used by a user who performs singing synthesis using a data set for singing synthesis does not coincide with a singing synthesis database that has been used for synthesis of the waveform data for listening contained in the data set for singing synthesis.

Where a singing synthesis database that is used by a user who performs singing synthesis using a data set for singing synthesis does not coincide with a singing synthesis database that has been used for synthesis of the waveform data for listening contained in the data set for singing synthesis, trial listening using the waveform data for listening is meaningless. This is because the singing synthesis database that can be used by the user is used for singing synthesis and a resulting singing voice should be different in auditory sensation from a singing voice represented by the waveform data for listening.

SUMMARY OF THE INVENTION

The present invention has been made in view of the above problem, and an object of the invention is therefore to provide a technique for allowing even a user who cannot use phoneme data that have been used for synthesis of singing voice data contained in a data set for singing synthesis has no problem in checking, in advance, an auditory sensation of a phrase corresponding to the data set for singing synthesis.

To solve the above problem, one aspect of the invention provides a singing voice edit assistant method including:

judging whether phoneme data, based on which waveform data for listening contained in a data set for singing synthesis is synthesized, is available or not for a user to edit a singing voice, wherein the data set for singing synthesis contains score data representing a time series of notes, a lyrics data representing words corresponding to the respective notes; and synthesizing the waveform data for listening while shifting pitches of phoneme data, representing waveforms of phonemes, indicated by the lyrics data to pitches indicated by the score data and connecting the pitch-shifted phoneme data and, wherein, if the indicated phoneme data is not available, the synthesizing synthesizes waveform data for listening based on the score data, the lyrics data, and substitute phoneme data available for the user instead of the indicated phoneme data.

In this aspect of the invention, if phoneme data, based on which waveform data for listening contained in a data set for singing synthesis is synthesized, is available for the user to edit the singing voice, the synthesized waveform data for listening is based on the score data, the lyrics data, and phoneme data that is available for the user to edit the singing voice. As a result, this aspect of the invention allows even a user who cannot use phoneme data that have been used for synthesis of singing voice data contained in a data set for singing synthesis has no problem in checking, in advance, an auditory sensation of a singing voice corresponding to the data set for singing synthesis.

For example, the edit assistant method further includes: writing into a memory, a data set for singing synthesis having the synthesized waveform data for listening. This mode enables reuse of a data set for singing synthesis whose waveform data for listening has been synthesized newly.

To solve the above problem, another aspect of the invention provides a singing voice edit assistant device including:

a memory configured to store instructions, and a processor configured to execute the instructions, wherein the instructions cause the processor to perform the steps of:

judging whether phoneme data, based on which waveform data for listening contained in a data set for singing synthesis is synthesized, is available or not for a user to edit a singing voice, wherein the data set for singing synthesis contains score data representing a time series of notes, a lyrics data representing words corresponding to the respective notes; and synthesizing the waveform data for listening while shifting pitches of phoneme data, representing waveforms of phonemes, indicated by the lyrics data to pitches indicated by the score data and connecting the pitch-shifted phoneme data and, wherein, if the indicated phoneme data is not available, the synthesizing synthesizes waveform data for listening based on the score data, the lyrics data, and substitute phoneme data available for the user instead of the indicated phoneme data.

Further aspects of the invention provide a program for causing a computer to execute the above-described judging process and synthesizing process, and a program for causing a computer to function as an editor, for example. As for the specific manner of providing these programs, a mode that they are delivered by downloading over a communication network such as the Internet and a mode that they are delivered being written to a computer-readable recording medium such as a CD-ROM (compact disc-read only memory) are conceivable.

BRIEF DESCRIPTION OF THE DRAWINGS

FIGS. 5A to 5C are graphs indicating examples of how a pitch curve of score data is edited.

FIG. 6 shows a singing style table that is incorporated in a singing synthesis program.

DETAILED DESCRIPTION OF THE EXEMPLARY EMBODIMENTS

An embodiment of the present invention will be hereinafter described with reference to the drawings.

Figure 1:
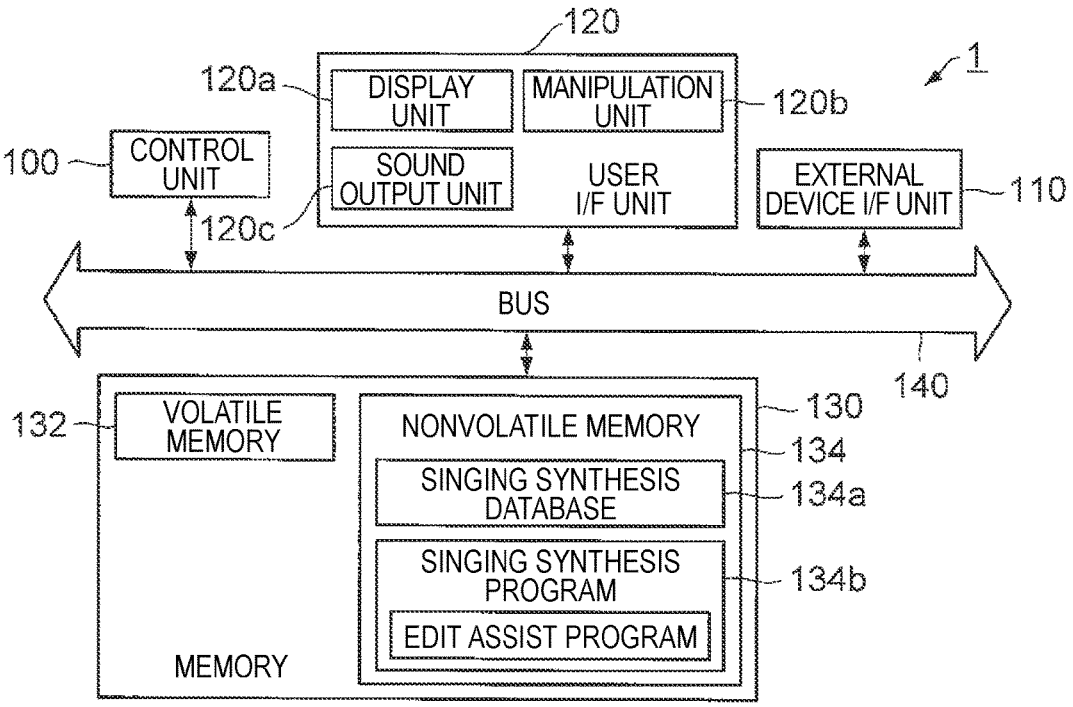
FIG. 1 is a block diagram showing an example configuration of a singing synthesizer 1 which performs an edit assistant method according to an embodiment of the present invention.

FIG. 1 is a block diagram showing an example configuration of a singing synthesizer 1 according to the embodiment of the invention. A user of the singing synthesizer 1 according to the embodiment can acquire a data set for singing synthesis by a data communication over a communication network such as the Internet and perform singing synthesis easily using the acquired data set for singing synthesis.

Figure 2:
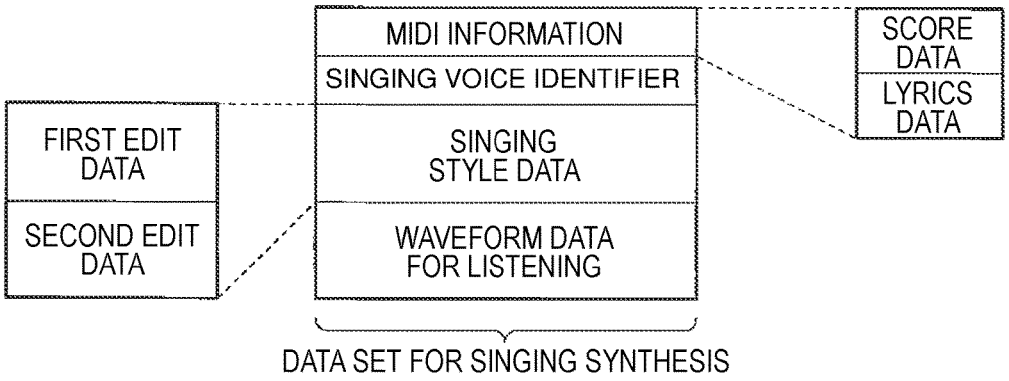
FIG. 2 is a diagram showing the structure of a data set for singing synthesis used in the embodiment.

FIG. 2 is a diagram showing the structure of a data set for singing synthesis used in the embodiment. The data set for singing synthesis used in the embodiment is data corresponding to one phrase and is data to be used for synthesizing, reproducing, or editing a singing voice of one phrase. The term "phrase" means a partial interval of a musical piece and is also called a "musical phrase." One phrase may either be shorter than one measure or correspond to one or plural measures. As shown in FIG. 2, the data set for singing synthesis used in the embodiment includes MIDI information, a singing voice identifier, singing style data, and waveform data for listening.

Figures 3, 4:
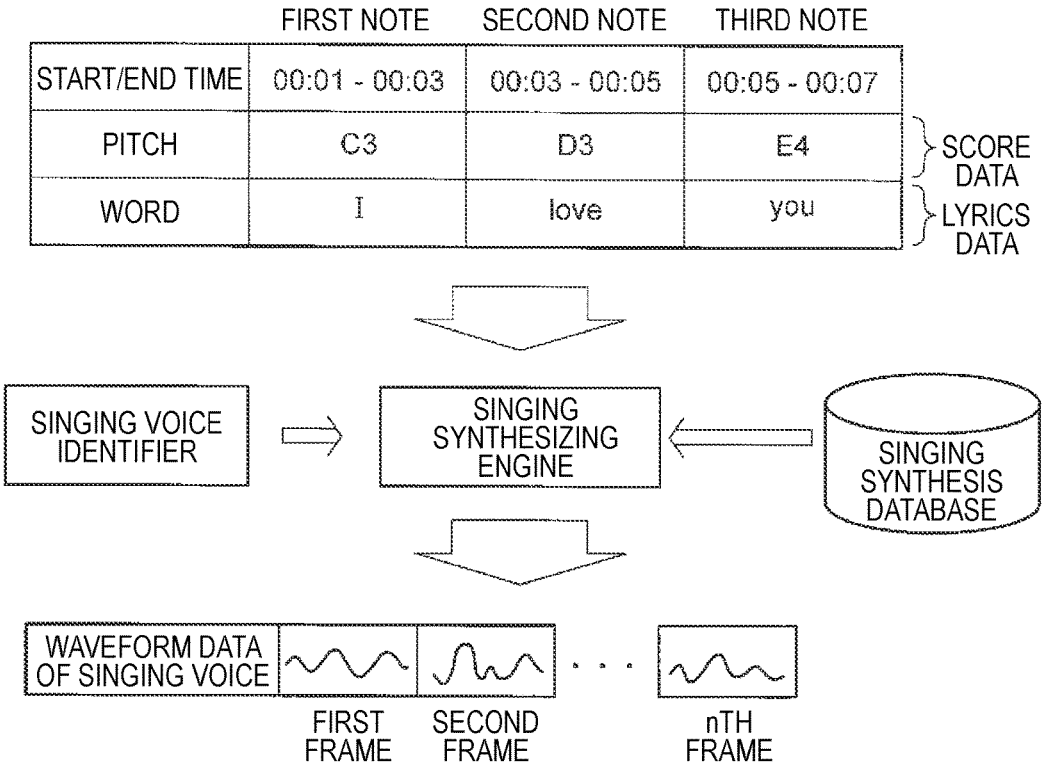
FIG. 3 is a diagram showing a relationship between score data, lyrics data, a singing voice identifier, and waveform data of a singing voice for listening that are included in the data set for singing synthesis.
FIG. 4 shows the details of first edit data.

The MIDI information is data that complies with, for example, the SMF (Standard MIDI File) format, and prescribes, in pronouncement order, note events to be pronounced. The MIDI information represents a melody and words of a singing voice of one phrase, and contains score data representing the melody and lyrics data representing the words. The score data is time-series data representing a time series of notes that constitute the melody of the singing voice of the one phrase. More specifically, as shown in FIG. 3, the score data is data indicating a pronunciation start time, a pronunciation end time, and a pitch. The lyrics data is time-series data representing the words of the singing voice of one phrase. As shown in FIG. 3, the lyrics data consists of plural pieces of word data each of which corresponds to a piece of note data of the score data. The word data corresponding to a note data is data indicating words (part of) of a singing voice to be synthesized using the note data. The data indicating words (part of) may be either text data representing characters constituting the word or data representing a phoneme of the word, that is, a consonant or vowel as an element of the word.

The waveform data for listening is waveform data representing a sound waveform of a singing voice that is synthesized by shifting phoneme waveforms indicated by the lyrics data to pitches indicated by the score data (pitch shifting) using the MIDI information, the singing voice identifier, and the singing style data that are included in the data set for singing synthesis together with the waveform data for listening and then connecting the pitch-shifted phoneme waveforms; that is, the waveform data for listening is a sample sequence of the sound waveforms. The waveform data for listening is used to check an auditory sensation of the phrase corresponding to the data set for singing synthesis.

The singing voice identifier is data for identification of a phoneme data group corresponding to a tone of voice of one particular person, that is, the same tone of voice (a group of plural phoneme data corresponding to a tone of voice of one person) among plural phoneme data contained in a singing synthesis database.

To synthesize a singing voice, a wide variety of phoneme data are necessary in addition to score data and lyrics data. Phoneme data are classified into groups by the tone of voice, that is, the singing person, and stored in the form of a database. Phoneme data groups of tones of voice of plural persons, each group corresponding to one tone of voice (i.e., the same tone of voice), are stored in the form of a single singing synthesis database. That is, the "phoneme data group" is a set (group) of phoneme data corresponding to each tone of voice and the "singing synthesis database" is a set of plural phoneme data groups corresponding to tones of voice of plural persons, respectively.

The singing voice identifier is data indicating a tone of voice of phonemes that were used for synthesizing the waveform data for listening, that is, data indicating a phoneme data group corresponding to what tone of voice should be used among the plural phoneme data groups (i.e., data for determining one phoneme data group to be used).

FIG. 3 is a diagram showing a relationship between score data, lyrics data, a singing voice identifier, and waveform data of a singing voice. The score data, the lyrics data, the singing voice identifier are input to a singing synthesizing engine. The singing synthesizing engine generates a pitch curve representing a temporal pitch variation of a phrase that is a target of synthesis of a singing voice by referring to the score data. Subsequently, the singing synthesizing engine generates waveform data of a singing voice by reading out, from the singing synthesis database, phoneme data that are determined by a tone of voice indicated by the singing voice identifier and phonemes of words indicated by the lyrics data, determining pitches in a time interval corresponding to the words by referring to the generated pitch curve, performs, on the phoneme data, pitch conversion for shifting to the determined pitches, and connecting resulting phoneme data in order of pronunciation.

In this embodiment, a data set for singing synthesis includes singing style data in addition to MIDI information, singing voice identifier, and waveform data for listening and that the waveform data for listening is synthesized using the singing style data in addition to the MIDI information and the singing voice identifier. The singing style data is data that prescribes individuality and acoustic effects of a singing voice that is synthesized or reproduced using the data of the data set for singing synthesis. The sentence "waveform data for listening is synthesized using the singing style data in addition to the MIDI information and the singing voice identifier" means that waveform data for listening is synthesized by adjusting the individuality and adding acoustic effects according to the singing style data.

The term "individuality of a singing voice" means a manner of singing of the singing voice. And a specific example of the adjustment of the individuality of a singing voice is performing an edit relating to the manner of variation of the sound volume and the manner of variation of the pitch so as to produce a singing voice that seems natural, that is, seems like a human singing voice. The adjustment of the individuality of a singing voice may be referred to as "adding or giving features/expressions to a singing voice", "an edit for adding or giving features/expressions to a singing voice" or the like. As shown in FIG. 2, the singing style data includes first edit data and second edit data.

The first edit data indicates acoustic effects (the edit of an acoustic effect) to be given to waveform data of a singing voice synthesized on the basis of the score data and the lyrics data. Specific examples of the first edit data are data indicating that the waveform data will be processed by a compressor and also indicating the strength of processing of the compressor, data indicating a band in which the waveform data is intensified or weakened and the degree of intensification or weakening, or data indicating that the singing voice will be subjected to delaying or reverberation and also indicating a delay time or a reverberation depth. In the following description, the equalizer may be abbreviated as EQ.

In the embodiment, as shown in FIG. 4, first edit data is prepared for each music genre such as a hard effect set that is suitable for hard rock etc. and a warm effect set that is suitable for warm music. Each piece of first edit data prescribes edit details of acoustic effects that are suitable for a certain music genre. For what music genre each piece of first edit data is suitable can be identified. For example, the first edit data contains data indicating a music genre corresponding to it. As shown in FIG. 4, the hard effect set is a combination of a strong compressor and an equalizer called a V-shaped sound equalizer, and the warm effect set is a combination of soft delaying and addition of reverberation. The term "V-shaped sound" means increasing the amplitude in a low-frequency range and a high-frequency range.

The second edit data is data that indicates an edit to be performed on singing synthesis parameters of the score data and the lyrics data and prescribes the individuality of a synthesized singing voice. Examples of the singing synthesis parameters are a parameter indicating at least one of the sound volume, pitch, and duration of each note of the score data, parameters indicating timing or the number of times of breathing and breathing strength, and a parameter indicating a tone of voice of a singing voice (i.e., a singing voice identifier indicating a tone of voice of a phoneme data group used for singing synthesis).

A specific example of the edit relating to the parameters indicating timing or the number of times of breathing and breathing strength is an edit of increasing or decreasing the number of times of breathing. A specific example of the edit relating to the pitch of each note of the score data is an edit performed on a pitch curve indicated by score data. And specific examples of the edit performed on a pitch curve are addition of a vibrato and rendering into a robotic voice.

The term "rendering into a robotic voice" means making a pitch variation so steep that the voice seems as if to be pronounced by a robot. For example, where score data has a pitch curve P1 shown in FIG. 5A, a pitch curve P2 shown in FIG. 5B is obtained by adding a vibrato and a pitch curve P3 shown in FIG. 5C is obtained by rendering into a robotic voice.

As described above, in the embodiment, an edit for adding acoustic effects to a singing voice and an edit for adjusting the individuality to it are different from each other in execution timing and edit target data. More specifically, the former is an edit that is performed after synthesis of waveform data, that is, an edit directed to waveform data that has been subjected to singing synthesis. The latter is an edit that is performed before synthesis of waveform data, that is, an edit performed on singing synthesis parameters of score data and lyrics data that are used in the singing synthesizing engine when singing synthesis is performed.

In the embodiment, one singing style is defined by a combination of an edit indicated by the first edit data and an edit indicated by the second edit data, that is, a combination of an edit for adjustment of the individuality of a singing voice and an edit for addition of acoustic effects to it; this is another feature of the embodiment.

The user of the singing synthesizer 1 can edit a singing voice of the entire song easily by generating track data for synthesis of the singing voice of the entire song by setting or arranging, in the time-axis direction, one or plural data sets for singing synthesis acquired over a communication network. The term "track data" means singing synthesis data reproduction sequence data that prescribes one or plural data sets for singing synthesis together with reproduction timing.

As described above, synthesis of a singing voice requires, in addition to score data and lyrics data, a singing synthesis database of plural phoneme data groups corresponding to plural respective kinds of tones of voice. A singing synthesis database 134*a* of plural phoneme data groups corresponding to plural respective kinds of tones of voice are installed (stored) in the singing synthesizer 1 according to the embodiment.

A wide variety of singing synthesis databases have come to be marketed in recent years, and a phoneme data group that is used for synthesizing waveform data for listening that is included in a data set for singing synthesis acquired by the user of the singing synthesizer 1 is not necessarily registered in the singing synthesis database 134*a*. In a case that the user of the singing synthesizer 1 cannot use a phoneme data group that is used for synthesizing waveform data for listening that is included in a data set for singing synthesis, the singing synthesizer 1 synthesizes a singing voice using a tone of voice that is registered in the singing synthesis database 134*a* and hence the tone of voice of the synthesized singing voice becomes different from that of the waveform data for listening.

The singing synthesizer 1 according to the embodiment is configured so as to enable listening that is useful for an edit of a singing voice even in a case that the user of the singing synthesizer 1 cannot use phoneme data that were used for synthesizing waveform data for listening that is included in a data set for singing synthesis; this is another feature of the embodiment. In addition, the singing synthesizer 1 according to the embodiment is configured so as to be able to generate or use, easily and properly, a phrase that has the individuality (a manner of singing) suitable for a music genre or a tone of voice desired by the user and are given acoustic effects suitable for the music genre or the tone of voice; this is yet another feature of the embodiment.

The configuration of the singing synthesizer 1 will be described below.

The singing synthesizer 1 is a personal computer, for example, and the singing synthesis database 134*a* and a singing synthesis program 134*b* are installed therein in advance. As shown in FIG. 1, the singing synthesizer 1 includes a control unit 100, an external device interface unit 110, a user interface unit 120, a MEMORY 130, and a bus 140 for data exchange between the above constituent elements. In FIG. 1, the external device interface unit 110 is abbreviated as an external device I/F unit 110 and the user interface unit 120 is abbreviated as a user I/F unit 120. The same abbreviations will be used below in the specification. Although in the embodiment the singing synthesis database 134*a* and the singing synthesis program 134*b* are installed in the computer, they may be installed in a portable information terminal such as a tablet terminal, a smartphone, or a PDA or a portable or stationary home game machine.

The control unit 100 is a CPU (central processing unit). The control unit 100 functions as a control nucleus of the singing synthesizer 1 by running the singing synthesis program 134*b* stored in the memory 130. Although the details will be described later, the singing synthesis program 134*b* includes an edit assist program which causes the control unit 100 to perform an edit assistant method which exhibits the features of the embodiment remarkably. The singing synthesis program 134*b* incorporates a singing style table shown in FIG. 6.

As shown in FIG. 6, singing style data (a combination of first edit data and second edit data) that indicates a singing style that is suitable for a tone of voice and songs of a music genre is contained in the singing style table so as to be correlated with a singing voice identifier indicating the tone of voice (i.e., identifying a phoneme data group contained in the singing synthesis database 134*a*) and a music genre identifier indicating the music genre. Phoneme data corresponding to the tone of voice are contained in the singing synthesis database 134*a*.

In the embodiment, the details of information that is contained in the singing style table are as follows. As shown in FIG. 6, a combination of second edit data indicating an edit of a change from the pitch curve P1 of FIG. 5A to the pitch curve P2 of FIG. 5B, that is, indicating an edit of adding a vibrato over the entire pitch curve, and first edit data indicating the hard effect set shown in FIG. 4 is correlated with a singer identifier indicating singer-1 and a music genre identifier indicating hard R & B. A combination of second edit data indicating an edit of a change from the pitch curve P1 of FIG. 5A to the pitch curve P2 of FIG. 5B, that is, indicating an edit of adding a vibrato over the entire pitch curve, and first edit data indicating the warm effect set shown in FIG. 4 is correlated with a singer identifier indicating singer-2 and a music genre identifier indicating warm R & B. A combination of second edit data indicating an edit of a change from the pitch curve P1 of FIG. 5A to the pitch curve P3 of FIG. 5C, that is, indicating an edit of rendering into a robotic voice over the entire pitch curve, and first edit data indicating the hard effect set shown in FIG. 4 is correlated with a singer identifier indicating singer-1 and a music genre identifier indicating hard robot. A combination of second edit data indicating an edit of a change from the pitch curve P1 of FIG. 5A to the pitch curve P3 of FIG. 5C, that is, indicating an edit of rendering into a robotic voice over the entire pitch curve, and first edit data indicating the warm effect set shown in FIG. 4 is correlated with a singer identifier indicating singer-2 and a music genre identifier indicating warm robot.

As described later in detail, the singing style table is used to generate or use, easily and properly, a phrase that is given individuality and acoustic effects suitable for a music genre and a tone of voice of a singer desired by the user.

Although not shown in detail in FIG. 1, the external device I/F unit 110 includes a communication interface and a USB (universal serial bus) interface. The external device I/F unit 110 exchanges data with an external device such as another computer. More specifically, a USB memory or the like is connected to the USB interface and data is read out from the USB memory under the control of the control unit 100 and transferred to the control unit 100. The communication interface is connected to a communication network such as the Internet by wire or wirelessly. The communication interface transfers, to the control unit 100, data received from the communication network under the control of the control unit 100.

The user I/F unit 120 includes a display unit 120*a*, a manipulation unit 120*b*, and a sound output unit 120*c*. For example, the display unit 120*a* has a liquid crystal display and its drive circuit. The display unit 120*a* displays various pictures under the control of the control unit 100. Example pictures displayed on the display unit 120*a* are edit assistant screen for assisting an user to edit a singing voice by prompting the user to perform various manipulations in a process of execution of the edit assistant method according to the embodiment.

The manipulation unit 120*b* includes a pointing device such as a mouse and a keyboard. If the user performs a certain manipulation on the manipulation unit 120*b*, the manipulation unit 120*b* gives data indicating the manipulation to the control unit 100, whereby the manipulation of the user is transferred to the control unit 100. Where the singing synthesizer 1 is constructed by installing the singing synthesis program 134*b* in a portable information terminal, it is appropriate to use its touch panel as the manipulation unit 120*b*.

The sound output unit 120*c* includes a D/A converter for D/A-converting waveform data supplied from the control unit 100 and outputs a resulting analog sound signal and a speaker for outputting a sound according to the analog sound signal that is output from the D/A converter.

As shown in FIG. 1, the memory 130 includes a volatile memory 132 and a non-volatile memory 134. The volatile memory 132 is a RAM (random access memory), for example. The volatile memory 132 is used as a work area by the control unit 100 in running a program. The non-volatile memory 134 is a hard disk drive, for example. The singing synthesis database 134*a* and the singing synthesis program 134*b* are stored in the non-volatile memory 134. Although not shown in detail in FIG. 1, a kernel program for realizing an OS (operating system) in the control unit 100 and a communication program to be used in acquiring a data set for singing synthesis are stored in the non-volatile memory 134 in advance. Examples of the communication program are a web browser and an FTP client. Plural data sets for singing synthesis acquired using the communication program are also stored in the non-volatile memory 134 in advance.

The control unit 100 reads out the kernel program from the non-volatile memory 134 triggered by power-on of the singing synthesizer 1 and starts execution of it. A power source of the singing synthesizer 1 is not shown in FIG. 1. The control unit 100 in which the OS is realized by the kernel program reads a program whose execution has been commanded by a manipulation on the manipulation unit 120*b* from the non-volatile memory 134 into the volatile memory 132 and starts execution of it. For example, when instructed to run the communication program by a manipulation on the manipulation unit 120*b*, the control unit 100 reads the communication program from the non-volatile memory 134 into the volatile memory 132 and starts execution of it. When instructed to run the singing synthesis program 134*b* by a manipulation on the manipulation unit 120*b*, the control unit 100 reads the singing synthesis program 134*b* from the non-volatile memory 134 into the volatile memory 132 and starts execution of it. A specific example of the manipulation for commanding execution of a program is mouse clicking on an icon displayed on the display unit 120*a* as an item corresponding to the program or tapping of it.

As shown in FIG. 1, the singing synthesis program 134*b* includes the edit assist program. The control unit 100 runs the edit assist program every time it is instructed by the user of the singing synthesizer 1 to run the singing synthesis program 134*b*. Upon starting execution of the edit assist program, the control unit 100 selects, sequentially, one by one, the plural data sets for singing synthesis stored in the non-volatile memory 134 and executes an edit process shown in FIG. 7. That is, the edit process shown in FIG. 7 is executed for each of the plural data sets for singing synthesis stored in the non-volatile memory 134.

Figure 7:
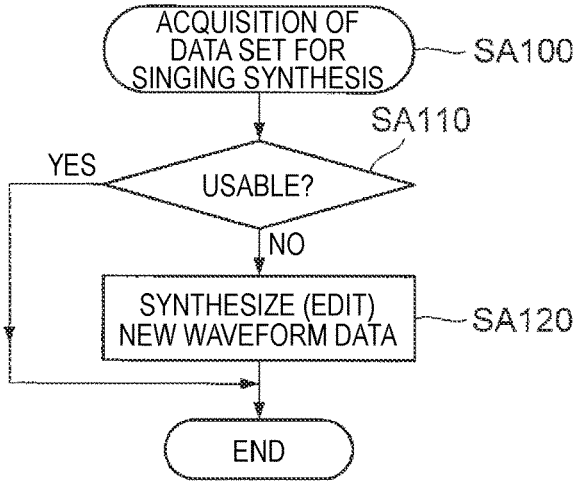
FIG. 7 is a flowchart of an edit process that is executed by a control unit 100 according to an edit assist program.

As shown in FIG. 7, at step SA100, the control unit 100 acquires a selected data set for singing synthesis as a processing target. At step SA110, the control unit 100 judges whether the user of the singing synthesizer 1 can use a phoneme data group that has been used for generating the waveform data for listening contained in the acquired data set for singing synthesis.

The phrase, "to acquire a selected data set for singing synthesis" means reading the selected data set for singing synthesis from the non-volatile memory 134 into the volatile memory 132. More specifically, at step SA110, the control unit 100 judges whether the phoneme data group having the tone of voice corresponding to the singing voice identifier contained in the data set for singing synthesis acquired at step SA100 is contained in the singing synthesis database 134*a*. If it is not contained in the singing synthesis database 134*a*, the control unit 100 judges that the user of the singing synthesizer 1 cannot use the phoneme data group that has been used for generating the waveform data for listening. That is, the judgment result of step SA110 becomes "no" if the phoneme data group having the tone of voice corresponding to the singing voice identifier contained in the data set for singing synthesis acquired at step SA100 is not contained in the singing synthesis database 134*a*.

If judgment result of step SA110 is "no," at step SA120 the control unit 100 edits the data set for singing synthesis acquired at step SA100 and finishes executing the edit process for the data set for singing synthesis. On the other hand, if judgment result of step SA110 is "yes," the control unit 100 finishes the execution of the edit process without executing step SA120.

More specifically, at step SA120, the control unit 100 deletes the waveform data for listening contained in the data set for singing synthesis acquired at step SA100 and newly synthesizes waveform data for listening for the acquired data set for singing synthesis using the score data, the lyrics data, and the singing style data that are contained in the acquired data set for singing synthesis and, in addition, a tone of voice that can be used by the user of the singing synthesizer 1 (i.e., a tone of voice corresponding to one of the plural phoneme data groups contained in the singing synthesis database 134*a*) in place of the tone of voice corresponding to the singing voice identifier contained in the acquired data set for singing synthesis.

The phoneme data group that is used for synthesizing waveform data for listening at step SA120 may be a phoneme data group that can be used by the user of the singing synthesizer 1, that is, a phoneme data group corresponding to a predetermined tone of voice or a phoneme data group corresponding to a tone of voice that is determined randomly using, for example, pseudorandom numbers among the plural phoneme data groups contained in the singing synthesis database 134*a*. Or the user may be caused to specify a phoneme data group to be used for synthesizing waveform data for listening. In either case, switching is made from the singing voice identifier that is contained in the data set for singing synthesis to the singing voice identifier indicating the tone of voice that has been used for newly synthesizing waveform data.

At step SA120, waveform data is synthesized in the following manner. First, the control unit 100 performs an edit indicated by the second edit data contained in the singing style data of the data set for singing synthesis acquired at step SA100 on the pitch curve indicated by the score data contained in the data set for singing synthesis acquired at step SA100. As a result, the individuality of a singing voice are adjusted. Then the control unit 100 synthesizes waveform data while shifting pitches of phoneme data to a pitch indicated by the edited pitch curve and connects the pitch-shifted phoneme data in order of pronunciation. The phoneme data represents a waveform of each phenome represented by the lyrics data contained in the acquired data set for singing synthesis. Furthermore, the control unit 100 generates waveform data for listening by giving acoustic effects to a singing voice by performing, on the thus-produced waveform data, an edit that is indicated by the first edit data contained in the singing style data of the data set for singing synthesis.

Figure 8:
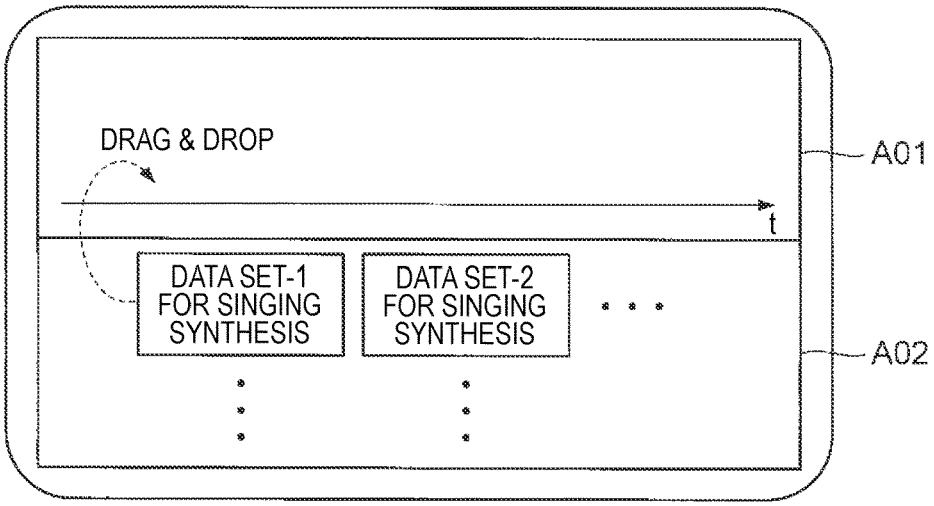
FIG. 8 shows an example edit assistant screen that is displayed on a display unit 120*a* by the control unit 100 according to the edit assist program.

Upon completion of the execution of the edit process shown in FIG. 7 on all of plural data sets for singing synthesis stored in the non-volatile memory 134, the control unit 100 which is operating according to the edit assist program displays an edit assistant screen shown in FIG. 8 on the display unit 120*a*. As shown in FIG. 8, the edit assistant screen has a track edit area A01 where to edit a singing voice using the data sets for singing synthesis stored in the non-volatile memory 134 (i.e., the data sets for singing synthesis that have been subjected to the edit process shown in FIG. 7) and a data set display area A02 where to display icons corresponding to the plural respective data sets for singing synthesis that have been subjected to the edit process shown in FIG. 7.

The user of the singing synthesizer 1 can instruct the control unit 100 to read out a data set for singing synthesis to be used for generating track data by dragging an icon displayed in the data set display area A02 to the track edit area A01, and can generate track data of a singing voice for synthesizing a desired singing voice by arranging the icons along the time axis tin the track edit area A01 (by dropping the icons at desired reproduction time points in the track edit area A01 (i.e., copying the data set for singing synthesis)).

When an icon corresponding to one data set for singing synthesis is dragged-and-dropped in the track edit area A01, the control unit 100 performs edit assist operations such as copying the one data set for singing synthesis to the track data and adding reproduction timing information to the track data so that a singing voice synthesized according to the data set for singing synthesis corresponding to the icon will be reproduced with reproduction timing corresponding to the position where the icon has been dropped.

Figure 9:
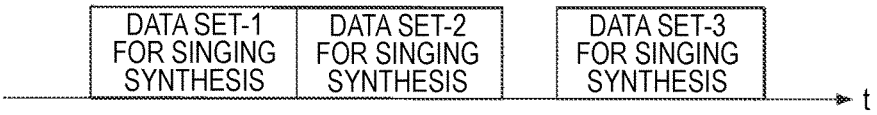
FIG. 9 is a diagram showing an example arrangement OF data sets for singing synthesis in a track edit area A01 of the edit assistant screen.

As for the manner of arrangement of the icons of the data sets for singing synthesis in the track edit area A01, icons may be arranged either with no interval between phrases as in data set-1 for singing synthesis and data set-2 for singing synthesis shown in FIG. 9 or with an interval between phrases as in data set-2 for singing synthesis and data set-3 for singing synthesis shown in FIG. 9.

The control unit 100 which is operating according to the edit assist program performs, according to instructions from the user, edit assist operations such as reproducing a singing voice corresponding to and changing the singing style of each of the data sets for singing synthesis arranged at a desired time point in the track edit area A01. For example, after arranging the data sets for singing synthesis to be used for generation of track data at positions corresponding to reproduction time points, the user can check an auditory sensation of a phrase corresponding to a data set for singing synthesis by reproducing a sound representing the waveform data for listening contained in the data set for singing synthesis by selecting its icon disposed in the track edit area A01 by mouse clicking, for example, and performing a prescribed manipulation (e.g., pressing the ctr key and the L key simultaneously). For another example, the user can change the singing style of a phrase corresponding to a data set for singing synthesis by selecting its icon displayed in the track edit area A01 by mouse clicking, for example, and performing a prescribed manipulation (e.g., pressing the ctr key and the R key simultaneously). Checking of an auditory sensation or changing of the singing style of a phrase corresponding to a data set for singing synthesis can be performed with any timing after dragging and dropping of its icon in the track edit area A01.

Figure 10:
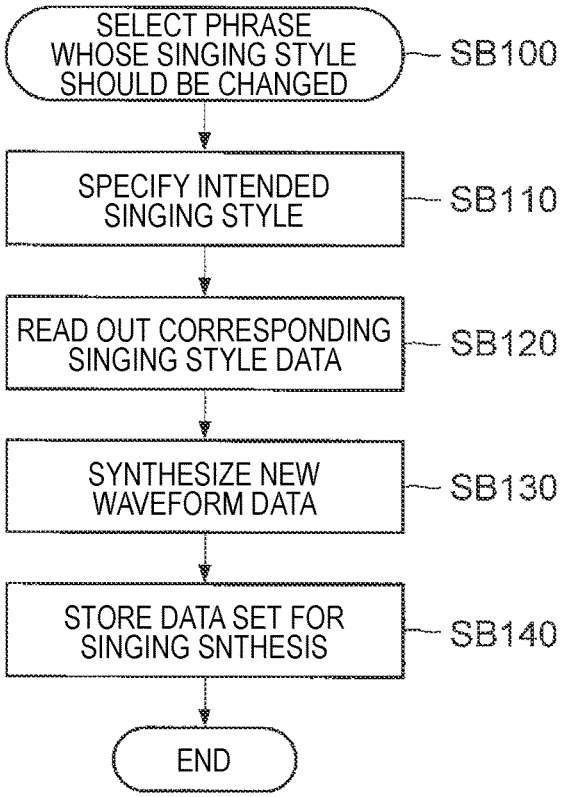
FIG. 10 is a flowchart of another edit process that is executed by the control unit 100 according to the edit assist program.
Figure 11:
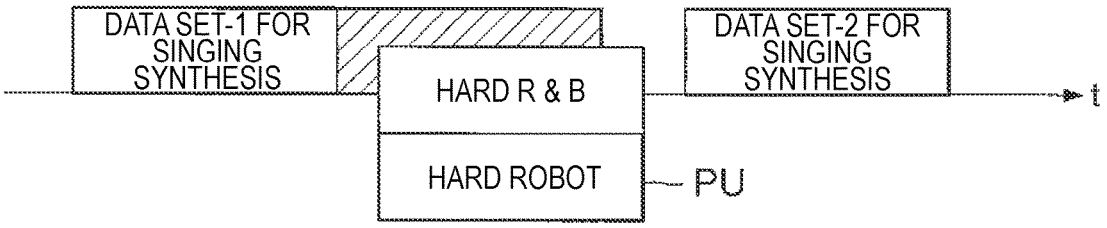
FIG. 11 shows an example display of a pup-up screen PU for specifying a singing style that the control unit 100 displays on a display unit 120*a* according to the edit assist program.

If one of the plural data sets for singing synthesis arranged in the track edit area A01 is selected and an instruction to change the singing style of the selected data set for singing synthesis is made, the control unit 100 executes an edit process shown in FIG. 10. As shown in FIG. 10, triggered by the selection of the data set for singing synthesis and the making of the instruction to change its singing style (step SB100), the control unit 100 displays, near the selected icon, a pop-up screen PU (see FIG. 11) for causing the user to specify an intended singing style. FIG. 11 shows an example in which data set-2 for singing synthesis shown in FIG. 9 is selected and an instruction to change its singing style has been made. The icon of the selected data set-2 for singing synthesis is hatched in FIG. 11.

Assume that waveform data is synthesized newly based on phonemes of singer-1 when the icon of data set-2 for singing synthesis is dragged and dropped in the track edit area A01. In this case, the music genre identifiers that are contained in the singing style table so as to be correlated with the singing voice identifier of singer-1 are list-displayed in the pop-up screen PU. The user can specify a singing style that is suitable for the music genre and the tone of voice of a singing voice that are indicated by a desired music genre by selecting it from the music genre identifiers list displayed in the pop-up screen PU.

When a singing style is selected in the above manner at step SB110 shown in FIG. 10, at step SB120 the control unit 100 reads out the corresponding singing style data from the singing style table. At step SB130, the control unit 100 synthesizes new waveform data by setting the read-out singing style data as the singing style data of the edit target data set for singing synthesis (overwriting). At step SB130, the control unit 100 synthesizes new waveform data for listening of the data set for singing synthesis selected at step SB100 using the newly set singing style data, in the same manner as at the above-described step SA120. At step SB130, in addition, the control unit 100 synthesizes new waveform data of a singing voice corresponding to the track data that is formed by the other respective data sets for singing synthesis that are arranged in the track edit area A01 together with the target data set for singing synthesis.

Upon completion of the execution of step SB130, at step SB140 the control unit 100 writes, to the non-volatile memory 134, the data set for singing synthesis whose singing style data has been updated and waveform data for listening has been synthesized newly at step SB130 (i.e., overwrites the data located at the position concerned of the track data). Then the execution of this edit process is finished.

The embodiment is directed to the operation that is performed when the singing style data of a data set for singing synthesis that is copied to the track edit area A01 is changed. Another operation is possible in which a copy of a data set for singing synthesis corresponding to an icon displayed in the data set display area A02 is generated triggered by a manipulation of selecting the icon and a manipulation of changing the singing style and the control unit 100 executes steps SB110 to SB140 with the copy as an edit target data set for singing synthesis. In this case, at step SB130, it suffices to perform only synthesis of new waveform data for listening of the edit target data set for singing synthesis. At step SB140, it is appropriate to correlate a new icon with the edit target data set for singing synthesis and write it to the non-volatile memory 134 separately from the original data set for singing synthesis.

In selecting a data set for singing synthesis and listening to a sound represented by the waveform data for listening contained in the selected data set for singing synthesis, it is possible to have the user set a new singing style and reproduce a singing voice in which acoustic effects indicated by the new singing style are added and the individuality are adjusted according to the new singing style. More specifically, it is appropriate to cause the control unit 100 to execute, triggered by setting of a new singing style, a process of synthesizing waveform data of a singing voice according to the score data, the lyrics data, and the singing voice identifier that are contained in the selected data set for singing synthesis and the singing style data of the newly set singing style and reproducing the synthesized waveform data as a sound. In this case, the waveform data for listening that is contained in the selected data set for singing synthesis may be overwritten with the synthesized waveform data. Alternatively, such overwriting may be omitted.

As described above, in the embodiment, if the user of the singing synthesizer 1 cannot use a phoneme data group, based on which waveform data for listening (hereinafter referred to as "original waveform data for listening") contained in a data set for singing synthesis, an edit assist operation of deleting the original waveform data for listening and synthesizing waveform data for listening is performed triggered by a start of the edit assist program. With this measure, even in a case that the user of the singing synthesizer 1 cannot use the phoneme data group that has been used in synthesizing an original waveform data for listening, no problems occur in listening of a singing voice corresponding to the data set for singing synthesis concerned in editing track data using the data set for singing synthesis.

In addition, in the embodiment, by performing a simple manipulation of specifying a music genre for a data set for singing synthesis constituting track data, singing style data of a singing style that is suitable for the specified music genre and its tone of voice is read out by the control unit 100 and the individuality are adjusted and acoustic effects are added for a singing voice corresponding to the data set for singing synthesis according to the singing style data. With this edit assist operation, the user can edit track data smoothly.

Although the embodiment is directed to the case the singing style is changed by specifying a music genre of a synthesis target singing voice, naturally the singing style may be changed by specifying a tone of voice of a synthesis target singing voice. In this manner, the embodiment makes it possible to adjust the individuality of a singing voice and add acoustic effects to the singing voice easily and properly in singing synthesis.

Although the embodiment of the invention has been described above, the following modifications can naturally be made of the embodiment:

(1) In the embodiment, the edit process shown in FIG. 7 is executed on all of the data sets for singing synthesis stored in the non-volatile memory 134 upon a start of the edit assist program. The following alternative process is possible in which the edit process shown in FIG. 7 is not executed upon a start of the edit assist program. When the data set for singing synthesis corresponding to an icon that has been dragged from the track edit area A01 and dropped in the track edit area A01 is copied triggered by drag-and-dropping of the icon (i.e., reading of the data set for singing synthesis to be used for generation of track data into the volatile memory 132, that is, acquisition of the data set for singing synthesis by the control unit 100), it is judged whether the user of the singing synthesizer 1 can use a phoneme data group of a tone of voice indicated by the singing voice identifier contained in the copied data set for singing synthesis. If it is usable, the data set for singing synthesis is copied as it is. If it is not usable, new waveform data for listening is synthesized as in the process shown in FIG. 7 and track data is edited (the data set for singing synthesis is copied and information indicating its reproduction timing is added to the track data). In this case, at step SA120, it is appropriate to synthesize new waveform data of a singing voice corresponding to the track data in addition to synthesizing new waveform data for listening to be contained in the data set for singing synthesis corresponding to the icon (i.e., the data set for singing synthesis copied to the track edit area A01).

The timing of acquisition of a data set for singing synthesis by the control unit 100 is not limited to after a time of reading of the data set for singing synthesis from the non-volatile memory 134 into the volatile memory 132, and may be, for example, after its downloading over a communication network or its reading from a recording medium into the volatile memory 132. In this case, if the judgment result at step SA110 is "no" for a data set for singing synthesis when it is acquired, it is appropriate to perform only deletion of the waveform data for listening from the data set for singing synthesis. New waveform data for listening is synthesized triggered by drag-and-dropping of the icon in the track edit area A01 or a start of the edit assist program.

(2) In the embodiment, addition of acoustic effects suitable for a music genre and a tone of voice of a singing voice to be synthesized and adjustment of the individuality are done together. Alternatively, individuality may be given to a singing voice by causing the singing synthesizer 1 to display a list of sets of individuality that can be given to a singing voice and causing the user to designate one of the list-displayed sets of individuality. Likewise, acoustic effects may be added to a singing voice by causing the user to designate them (independently of addition of individuality). In this mode, the user can freely specify a combination of individuality and acoustic effects to be added to a singing voice and adjust the individuality of a singing voice and add acoustic effects to the singing voice easily and freely.

(3) In the embodiment, a data set for singing synthesis is generated phrase by phrase. Alternatively, a data set for singing synthesis may be generated in units of a part such as am a melody, a B melody, or a catchy part, in units of a measure, or even in units of a song.

Although the embodiment is directed to the case that one data set for singing synthesis contains only one piece of singing style data, one data set for singing synthesis may contain plural singing style data. More specifically, a mode is conceivable in which a singing style obtained by averaging singing styles represented by the plural respective singing style data over the entire interval of a data set for singing synthesis is applied in the interval. For example, where a data set for singing synthesis contains rock singing style data and folk song singing style data, it is expected that a singing voice whose individuality and acoustic effects lie halfway between the individuality and acoustic effects of rock and those of a folk song (as in rock Soran-bushi) could be synthesized by applying an intermediate singing style between the two kinds of singing style data. In this manner, it is expected that this mode could create new singing styles.

Figure 12:
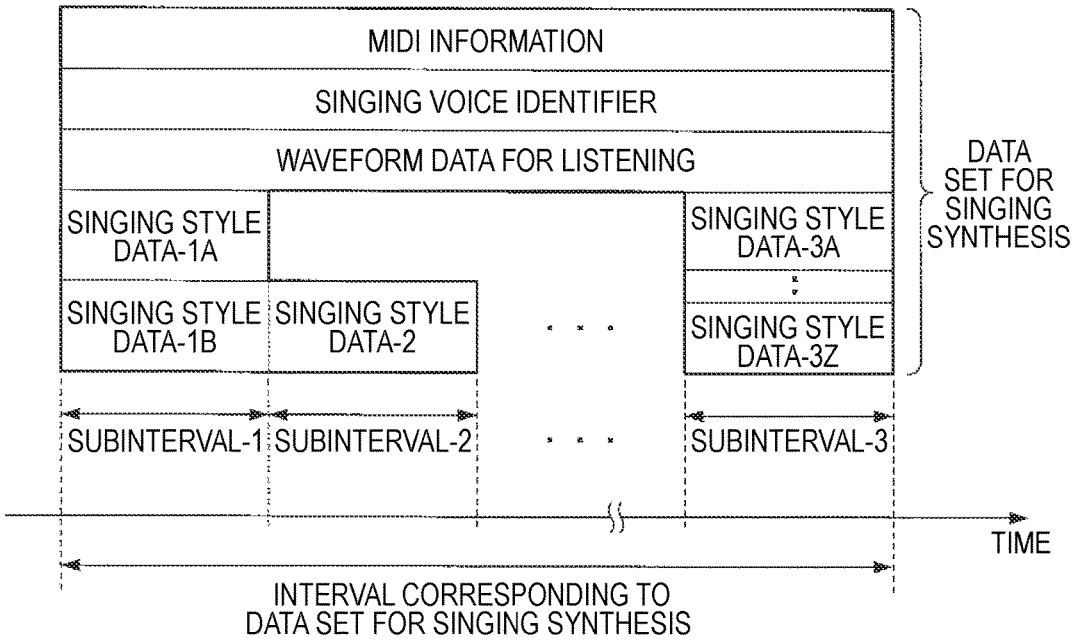
FIG. 12 is a diagram illustrating a modification of the embodiment.

Another mode is conceivable in which as shown in FIG. 12 an interval corresponding to a data set for singing synthesis is divided into plural subintervals and one or plural singing style data are set for each subinterval. This mode makes it possible to adjust the individuality of a singing voice and give acoustic effects to the singing voice finely, that is, in units of a subinterval.

(4) In the embodiment, an edit of a singing voice is assisted by enabling use of a data set for singing synthesis and specifying of a singing style. Alternatively, only one of use of a data set for singing synthesis and specifying of a singing style may be supported, because even supporting only one of them makes an edit of a singing voice easier than in the prior art. Where use of a data set for singing synthesis is supported but specifying of a singing style is not, a data set for singing synthesis need not contain singing style data, in which case a data set for singing synthesis may be formed by MIDI information and singing voice data (waveform data for listening).

(5) Although in the embodiment an edit screen is displayed on the display unit 120*a* of the singing synthesizer 1, an edit screen may be displayed on a display device that is connected to the singing synthesizer 1 via the external device I/F unit 110. Likewise, instead of using the manipulation unit 120*b* of the singing synthesizer 1, a mouse and a keyboard that are connected to the singing synthesizer 1 via the external device I/F unit 110 may serve as a manipulation input device for inputting various instructions to the singing synthesizer 1. Furthermore, an external hard disk drive or a USB memory that is connected to the singing synthesizer 1 via the external device I/F unit 110 may serve as a storage device to which a data set for singing synthesis is to be written.

Although in the embodiment the control unit 100 of the singing synthesizer 1 performs the edit assistant method according to the invention, an edit assistant device that performs the edit assistant method may be provided as a device that is separate from a singing synthesizer.

Figure 13:
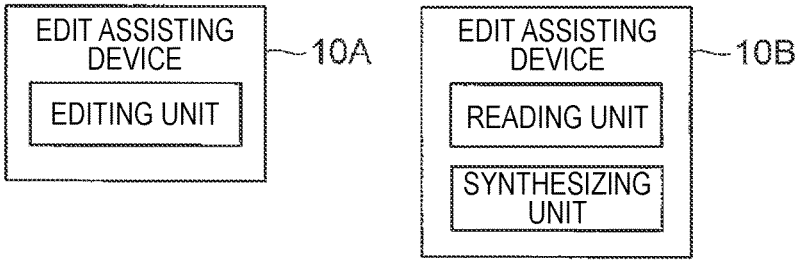
FIG. 13 shows example configurations of edit assistant devices 10A and 10B according to respective modifications of the embodiment.

For example, as shown in FIG. 13, it suffices that an edit assistant device 10A which assists a edit of a singing vice by enabling use of a data set for singing synthesis that has score data, lyrics data, and singing voice data be equipped with an editing unit which executes an edit step (step SA120 shown in FIG. 7). The editing unit judges whether a user of the edit assistant device 10A can use phenome data that were used for synthesizing the singing voice data contained in the data set for singing synthesis. If the phenome data are not usable, the edit assistant device 10A deletes the waveform data for listening contained in the data set for singing synthesis and the user synthesizes new waveform data for listening based on phoneme data (substitute phoneme data) that can be used by the user, the score data, and the lyrics data instead of the phoneme data which has not been usable.

A program for causing a computer to function as the above editing unit may be provided. This mode makes it possible to use a common computer such as a personal computer or a tablet terminal as the edit assistant device according to the invention. Furthermore, a cloud mode is possible in which the edit assistant device is implemented by plural computers that can cooperate with each other by communicating with each other over a communication network, instead of a single computer.

On the other hand, as shown in FIG. 13, it suffices that an edit assistant device 10B which assists an edit of a singing voice by making it possible to specify a singing style be equipped with a reading unit which executes a reading step (step SB120 shown in FIG. 10) and a synthesizing unit which executes a synthesizing step (step SB130 shown in FIG. 10). The reading unit reads out singing style data that prescribes individuality of a singing voice and acoustic effects to be added to the singing voice that is represented by singing voice data to be synthesized based on score data representing a time series of notes and lyrics data representing words corresponding to the respective notes. The synthesizing unit synthesizes singing voice data by adjusting the individuality and adding acoustic effects based on the singing style data read out by the reading unit. A cloud mode is also possible in this case. Programs for causing a computer to function as the reading unit and the synthesizing unit may be provided.

Singing style data having such a data structure as to include first data (first edit data) indicating a signal processing to be executed on singing voice data to be synthesized based on score data representing a time series of notes and lyrics data representing words corresponding to the respective notes and second data (second edit data) indicating a modification on values of parameters to be used in the synthesis of the singing voice data may be delivered in the form of a recording medium such as a CD-ROM or by down-loading over a communication network such as the Internet. The number of kinds of singing styles from which the singing synthesizer 1 can select can be increased by storing singing style data delivered in this manner in such a manner that it is correlated with a singing voice identifier and a music genre identifier.

What is claimed is:

1. A singing voice edit assistance method, performed by a computer, comprising:

judging whether phoneme data, based on which waveform data for listening contained in a data set for singing synthesis is synthesized, is available or not for a user to edit a singing voice, wherein the data set for singing synthesis contains score data representing a time series of notes and lyrics data representing words corresponding to the respective notes; and synthesizing the waveform data for listening while shifting pitches of phoneme data, representing waveforms of phonemes, indicated by the lyrics data to pitches indicated by the score data and connecting the pitch-shifted phoneme data and, wherein, if the indicated phoneme data is not available, the synthesizing synthesizes new waveform data for listening based on the score data, the lyrics data, and substitute phoneme data available for the user instead of the indicated phoneme data.

2. The edit assistance method according to claim 1, further comprising:

writing into a memory, a data set for singing synthesis having the newly synthesized waveform data for listening.

3. The edit assistance method according to claim 1, wherein the judging process is conducted when the data set for singing synthesis is arranged at a desired time point in a track edit area.

4. The edit assistance method according to claim 1, wherein it is judged in the judging process that the indicated phoneme data is available if the indicated phoneme data is stored in a singing synthesis database which contains various phoneme data.

5. A singing voice edit assistance device comprising:

a memory configured to store instructions, and a processor configured to execute the instructions, wherein the instructions cause the processor to:

judge whether phoneme data, based on which waveform data for listening contained in a data set for singing synthesis is synthesized, is available or not for a user to edit a singing voice, wherein the data set for singing synthesis contains score data representing a time series of notes, a lyrics data representing words corresponding to the respective notes; and synthesize the waveform data for listening while shifting pitches of phoneme data, representing waveforms of phonemes, indicated by the lyrics data to pitches indicated by the score data and connecting the pitch-shifted phoneme data and, wherein, if the indicated phoneme data is not available, new waveform data for listening is synthesized based on the score data, the lyrics data, and substitute phoneme data available for the user instead of the indicated phoneme data.

6. The edit assistance device according to claim 5, wherein the instructions cause the processor to:

write into a memory, a data set for singing synthesis having the newly synthesized waveform data for listening.

7. The edit assistance device according to claim 5, wherein the judging process is conducted when the data set for singing synthesis is arranged at a desired time point in a track edit area.

8. The edit assistance device according to claim 5, wherein it is judged in the judging process that the indicated phoneme data is available if the indicated phoneme data is stored in a singing synthesis database which contains various phoneme data.

* * * * *